United States Patent [19]

Kaltenegger

[11] 4,121,364

[45] Oct. 24, 1978

[54] HAND-HELD FIREARMS

[76] Inventor: Benno Kaltenegger, Auf dem hohen Ufer 14, 5205 St. Augustin-Meindorf, Fed. Rep. of Germany

[21] Appl. No.: 790,039

[22] Filed: Apr. 22, 1977

[30] Foreign Application Priority Data

Apr. 24, 1976 [DE] Fed. Rep. of Germany ..... 2617953

[51] Int. Cl.[2] ..... F41C 11/00

[52] U.S. Cl. ..... 42/32

[58] Field of Search ..... 42/26, 32, 33

[56] References Cited

U.S. PATENT DOCUMENTS

| | | | |
|---|---|---|---|
| 152,957 | 7/1874 | Snell | 42/32 |
| 1,411,800 | 4/1922 | Molloy | 42/32 |
| 3,142,924 | 8/1964 | Ruger et al. | 42/32 |

FOREIGN PATENT DOCUMENTS

| | | | |
|---|---|---|---|
| 79,714 | 10/1950 | Czechoslovakia | 42/26 |

*Primary Examiner*—Charles T. Jordan

[57] ABSTRACT

This disclosure is directed to a firearm which includes a casing defining a recess with the latter being in part defined by a pair of upper spaced bridge members, a lateral opening between the bridge members opening into the recess, a breech block, means mounting the breech block in the recess for pivotal movement toward and away from the lateral opening, means for firing a cartridge located in a cartridge chamber opening in a direction toward the recess, a trigger mechanism for operating the firing means, an ejector mechanism for ejecting spent cartridges from the cartridge chamber, and the trigger and ejector mechanisms being substantially entirely located beneath the cartridge chamber.

21 Claims, 6 Drawing Figures

HAND-HELD FIREARMS

The present invention is directed to firearms, and specifically hand-held firearms in the form of sporting or hunting guns, bullet-firing rifles, hand guns and the like.

Hand-held or small firearms are well known as are so-called breech blocks associated therewith. Firearms of this type which include breech blocks require a relatively large amount of space in an associated lock or gun casing and this results in the lock casing having a relatively large rearwardly opening gap or opening. Due to the size of the latter, the overall strength of the casing is reduced as is its resistance to stresses caused by the firing of an associated cartridge. This leads to the obvious problem of a particular firearm being suitable only for cartridges of restricted caliber or power. However, in the case of sporting rifles, it is highly desirable to utilize large caliber cartridges, or for that matter, lesser caliber cartridges with heavy loads.

In keeping with the present invention, it is a primary object thereof to provide a firearm, particularly a sporting or hunting firearm, such as a bullet-firing rifle, which is suitable particularly for large-caliber cartridges or high-loaded cartridges of most any size in which the locking or lock mechanism associated therewith is of greater simplicity than that heretofore known and thus is of greater reliability.

In keeping with the firearm constructed in accordance with the present invention, a breech block is provided in a recess of a casing and the latter includes a lateral opening through which the breech block may be pivoted into or away from the casing recess, a cartridge chamber opening in a direction toward the casing recess, the casing recess is further defined in part by a pair of laterally spaced upper bridge members, and both a trigger mechanism and an ejector mechanism of the firearm are substantially entirely located beneath the cartridge chamber.

By virtue of the latter-noted design, which might also include a cocking mechanism substantially located beneath the cartridge chamber, a firearm is not only provided which is capable of firing large-caliber cartridges, but there results from this construction an overall compact weapon which can be made considerably shorter than heretofore while retaining the conventional barrel length. In this manner, improved handling of the weapon may be achieved.

In addition, due to the fact that the bridge members form part of the casing and are continuous from a forward portion of the casing to a desired point behind the breech block, the breech block itself is housed in an extremely rigid and compact casing. This construction enables the breech block and casing to directly absorb extremely high forces, such as occur upon the firing of an associated cartridge. The bridge members impart to the casing a high degree of stability which is particularly desirable in competitive gunning or shooting contests.

In keeping this invention, the firearm also includes a lock mechanism which is also rendered very compact due to the fact that the firearm barrel is extended rearward to the breech block and beyond an associated trigger or trigger lever. This construction permits the overall trigger mechanism and an associated cocking mechanism for a striker pin to lie forward of the rearmost end of the barrel when the various components are viewed from the side or in longitudinal section. This again leads to a shortening of the overall length of the firearm so that it may obviously be more easily and safely handled.

In accordance with another object of this invention a tubular spindle or sleeve carried by the casing projects into the casing recess and the breech block embraces the spindle by means of a slot formed in the breech block which opens through a periphery of the latter. A spring-biased locking mechanism carried by the breech block is provided to lock the breech block within the casing recess when the firearm is to be fired yet can be overcome to pivot the breech block toward the lateral opening in order that a spent cartridge may be ejected. The spring-locking mechanism also secures the weapon against unintentional use by third parties in a very simple and a very effective way. Due to the slot formed in the breech block the latter may be rapidly removed from the casing recess through the lateral opening and thus the weapon cannot be fired inadvertently or accidentally. This removal feature of the breech block also serves as added protection against theft since the weapon is obviously useless unless provided with the breech block.

In further accordance with this invention, the spindle upon which the breech block is pivotally mounted is preferably a tube or sleeve in which is slidably received a striker pin having opposite terminal ends, the first of which is adjacent the breech block and a second of which is remote therefrom. The first end portion of the striker pin cooperates through the intermediary of a pivotally mounted rocker arm to move a firing pin when an associated trigger lever is pulled while the second end of the striker pin is associated with a spring-loaded cocking lever having a handle directed away from the rear of the weapon such that upon cocking or pivoting the cocking lever, the striking pin is drawn in a direction away from the breech block against the bias of a spring to load the striker pin which upon release through the intermediary of the trigger results in the rocking of the rocker arm and motion of the firing pin to cause the discharge of an associated cartridge housed in a cartridge chamber of the weapon.

In further keeping with this invention, a snapaction catch mechanism is disposed between the tubular sleeve and the firing pin of the breech block, and the latter releasably locks the breech block in its firing position.

In further keeping with this invention, the ejector mechanism of the invention includes an ejector pin normally spring-biased in a direction toward the breech block, an end of the pin adjacent the breech block carrying a cartridge extractor element adapted to seat behind the rim of a cartridge for removing the latter from the cartridge chamber, and guide means for guiding relative movement of the extractor member into and out of a recess of the casing which conforms to the peripheral outer contour of the extractor member. When the breech block is pivoted toward the lateral opening, a cartridge is automatically ejected from the cartridge chamber by the extractor member and upon loading of a new cartridge, the extractor member is seated in its recess due to the guidance afforded by the guiding means last-mentioned.

In further accordance with this invention, the trigger or trigger lever is positioned generally directly beneath the firing pin and an intermediate lever is pivotally disposed between the striker pin and the trigger lever. An upper face of the trigger lever has a groove opening toward the intermediate lever which provides a certain degree of play in the trigger lever before it acts on the intermediate lever which establishes a pressure-point only upon the intermediate lever being fully disposed in the groove. This degree of "play" or the pressure-point may be adjusted and this is achieved by providing a threaded bore in the trigger which opens through the groove thereof into which is threaded a set screw which can be moved toward the intermediate lever to lessen the play or retracted from the intermediate lever to increase the play, as might be desired by a particular person utilizing the weapon.

With the above, and other objects in view that will hereinafter appear, the nature of the invention will be more clearly understood by reference to the following detailed description, the appended claims and the several views illustrated in the accompanying drawings.

Figure 5:
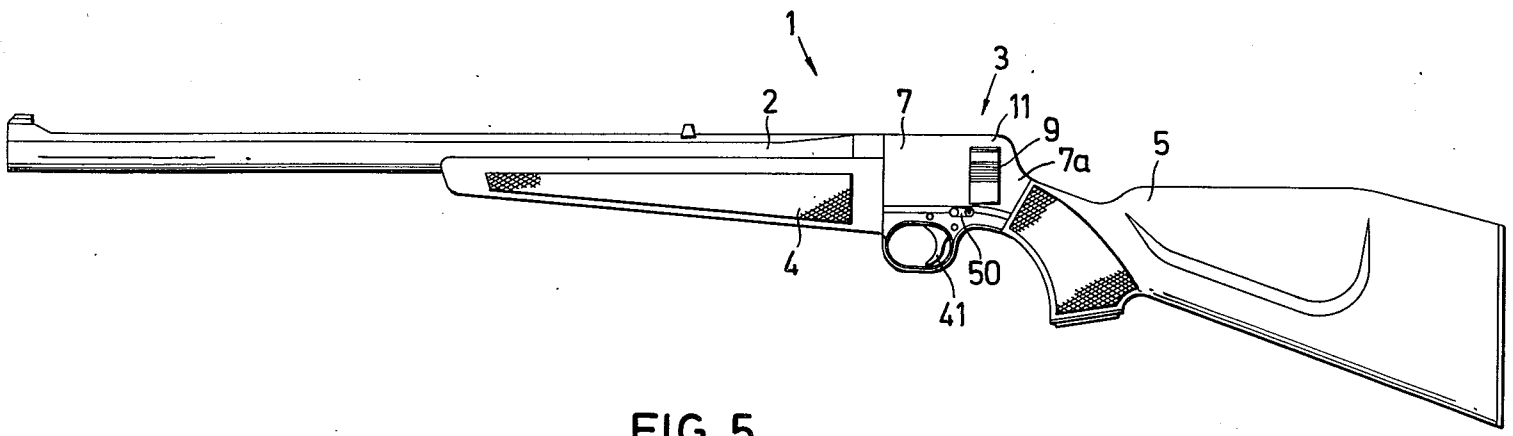
FIG. 5 is a side elevational view, and illustrates the overall firearm including in addition to the casing, a barrel, stock and butt.

A novel firearm constructed in accordance with this invention is fully illustrated in FIGS. 1 through 5 and is generally designated by the reference numeral 1. In this case the firearm 1 is a sporting rifle or a cartridge or bullet-firing rifle having a barrel 2, a locking or lock mechanism 3, a stock 4 and a butt 5 (FIG. 5). An innermost end of the barrel 2 includes a cartridge chamber 6 for receiving a cartridge 24 having a rim or edge 24*a*. A lock casing 7 in which is located the lock mechanism 3 is treadably secured to a threaded portion of the barrel 2.

Figure 2:
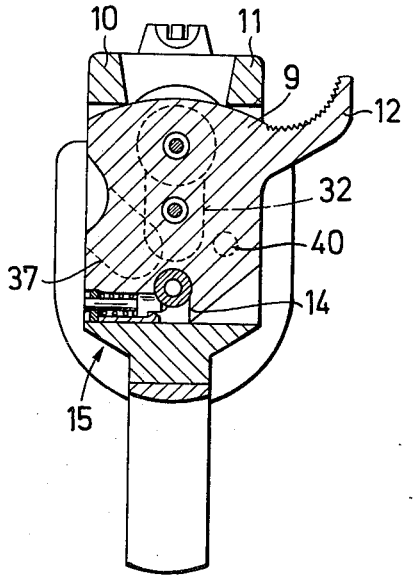
FIG. 2 is a cross-sectional view taken generally along line II—II of FIG. 1, and illustrates a tubular spindle straddled by a slot of the breech block and a locking mechanism for maintaining the breech block assembled to the spindle.
Figure 3:
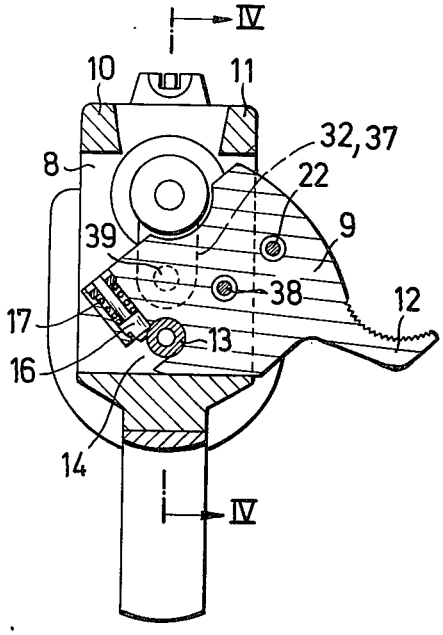
FIG. 3 is a view identical to FIG. 2, but illustrates the breech block being pivoted outwardly of the casing recess through a lateral opening to expose the cartridge for ejection or loading purposes.
Figure 4:
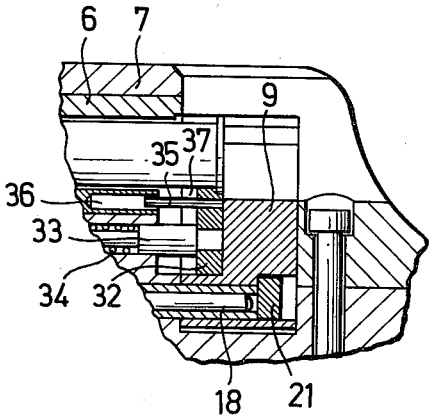
FIG. 4 is a fragmentary sectional view taken generally along line IV—IV of FIG. 3, and illustrates the further details of the components of the firearm.

The casing 7 includes a recess 8 (FIG. 3) having openings at each of its two lateral sides (FIG. 3) into one or the other of which may pivot a breech block or pivot block 9 (FIGS. 2 and 3).

In FIG. 2 the breech block 9 is housed generally entirely within the recess 8 in its "firing" position, while in FIG. 3 the breech block 9 is pivoted partially outwardly of the recess 8 to its "ejecting" position to provide an access area through which the cartridge 24 may be ejected.

The casing 7 also includes a pair of laterally spaced bridge members or straps 10, 11 (FIGS. 2 and 3) which are integral rearward extensions of the casing 7 and are bridged adjacent the butt 5 by an integral bridging portion 7*a* (FIG. 1) through which a bolt may be passed to secure the bridging portion 7*a* and thus the bridge members 10, 11 to a bottom-most portion of the casing 7 and the butt 5.

Figure 1:
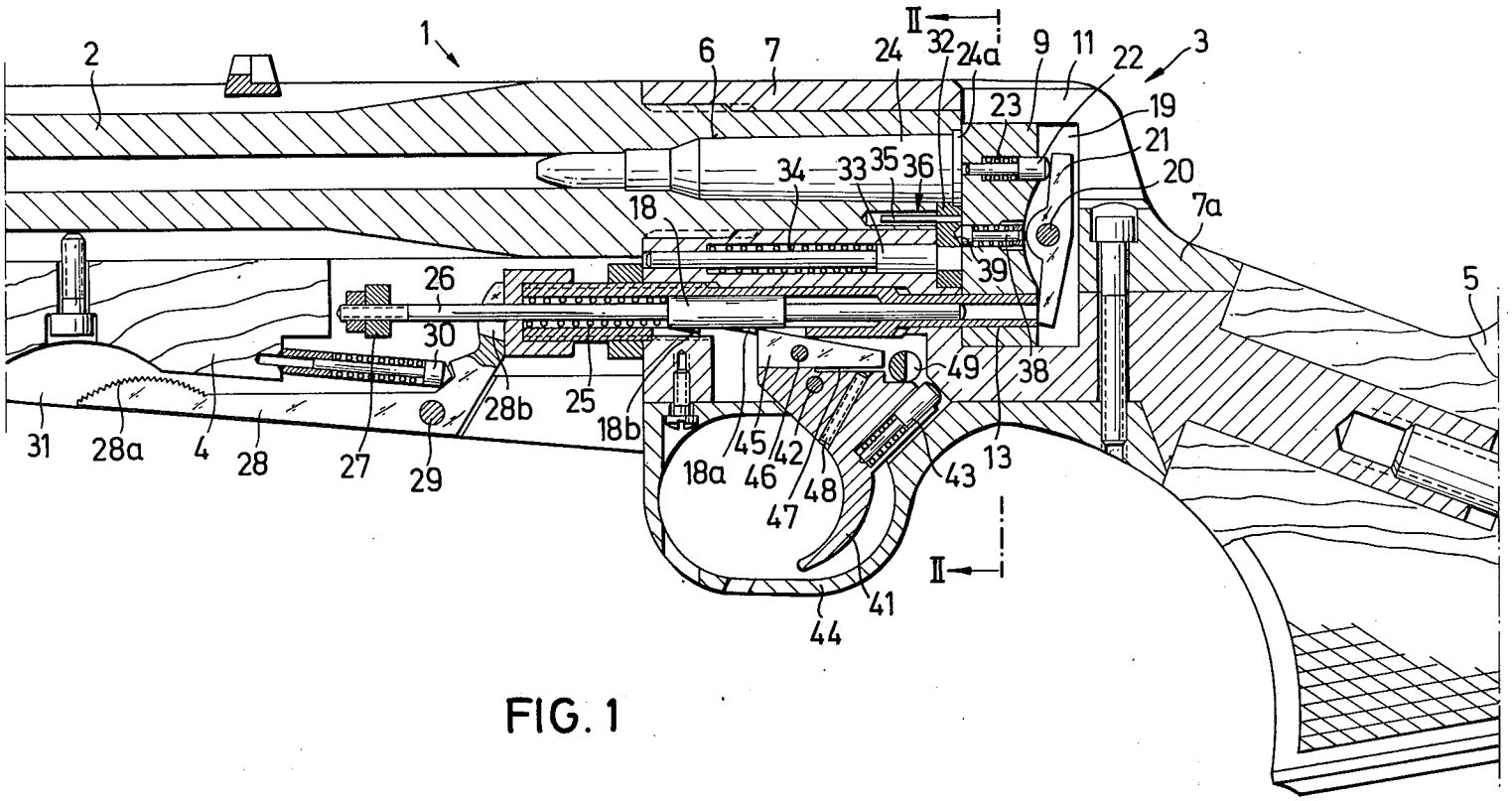
FIG. 1 is a fragmentary longitudinal sectional view of a novel firearm constructed in accordance with this invention, and illustrates a pivotally mounted breech block housed in a recess of a casing with both an ejector mechanism and a trigger mechanism being disposed substantially entirely beneath a cartridge chamber of a barrel of the firearm.

The breech block 9 has a handle 12 (FIGS. 2 and 3) and through an externally opening slot 14 (FIGS. 2 and 3) is pivotally mounted atop a tubular spindle or sleeve 13 which projects into the recess 8 in the manner best illustrated in FIG. 1. A snap catch 15 (FIG. 2) is carried by the breech block 9 and is defined by a locking bolt 6 which is spring-biased by a compression spring 17. the bolt 16 is so located that it projects inwardly beneath the axis of the spindle 13 into the open slot 14, as is best illustrated in FIGS. 2 and 3. When the breech block 9 is pivoted outwardly through the lateral opening, as shown in FIG. 3, one's finger or a tool can be inserted in the area of the slot 14 to move the bolt 16 further away from the spindle 13 against the bias of the spring 7 to release the breech block 9 from the spindle 13 and thus permit the removal of the breech block 9 from the recess 8. By thus removing the breech block 9 the firearm 1 cannot be used unintentionally, inadvertently or accidentally by third parties, unless, of course, another breech block is provided therefor and reassembled in the manner shown in FIG. 2.

Housed at least partially within the tube, sleeve or spindle 13 is a striker pin 18 having a first end portion adjacent the breech block 9 and an opposite end portion of extension 26. The purpose of the unnumbered portion of the striker pin 18 is to impactingly strike against a terminal end of a rocker arm 21 pivotally mounted in the casing 7 by a pivot pin 20. The rocker arm 21 is housed in a groove or recess of the casing which opens in a direction toward the breech block 9. The upper end of the rocker arm 21 is in alignment to contact firing means in the form of a firing pin 22 slidably carried by the breech block 9 and spring-biased by compression spring 23 normally to the right as viewed in FIG. 1. The firing pin 22 acts against the rim or inboard of the rim 24*a* of the cartridge 24 in a conventional manner to detonate the same. The latter action is caused by the counter-clockwise pivoting of the rocker arm 21 under the influence of the striker pin 18 when the latter is released in the manner heretofore described under the influence of a compression spring 25 housed within a portion of the sleeve 13 closed by a cap outwardly of which projects the extension 26 of the striker pin 18. The extension 26 carries an adjustable stop 27 in the form of a threaded nut which is threaded upon a terminal end portion of the extension 26. Cocking means in the form of a cocking lever 28 is pivotally connected to the firearm 1 by a transverse pivot pin or spindle 29. The cocking lever 28 includes a handle 28*a* projecting in the direction away from the butt 5 and a bifurcated arm 28*b* receiving the extension 26 of the striker pin 18. By rotating the cocking lever 28 counter-clockwise against the spring-bias of a spring-loaded bolt 30, the bifurcated end 28*b* of the cocking lever 28 bears against the nut 27 of the extension 26 of the striker pin 18 to move the striker pin 18 from a right-hand most position to the position shown in FIG. 1. By adjusting the nut 27 along the threaded terminal end of the extension 26 one can regulate the tension applied to the spring 25 and thus the eventual force which will be imparted by the striker pin 18 against the rocker arm 21 to move the firing pin 22. An ejector mechanism of the firearm 1 includes an extractor or extractor member 32 which engages behind the edge or rim 24*a* of the cartridge 24 when the latter is housed in a cartridge chamber 6. The extractor member 32 is carried by a terminal end of a bolt 33 which is normally biased to the right, as shown in FIG. 1, by a compression spring 34. The extractor member 32 is guided in its movement toward and away from the breech block 9 by means of a pin 35 fixed to the extractor member 32 and received in a guide bore 36 of the barrel 2. The barrel 2 has a right-hand most face which is provided with a recess contoured to the configuration of the extractor member 32 such that the extractor member 32 is housed in this recess when the breech block 9 is in the position shown in FIGS. 1 and 2. In addition, the breech block 9 has a similar recess 37 (FIGS. 2 and 3) likewise contoured to the configuration of the extractor 32 and opening in a direction facing the extracor 32 such that upon the breech block 9 being positioned as shown in FIG. 3, the extractor is free to move into the recess 37 of the breech block 9 thereby ejecting partially or totally the spent cartridge from the cartridge chamber 6. The angle of pivoting of the breech block 9 is approximately 50°, although this may be varied. When a new cartridge is inserted into the cartridge chamber 6 the extractor 32 is pushed back to its original position (FIG. 1) whereupon the breech block 9 can be pivoted back to its closed position (FIG. 2). The limit positions of the pivoting movement of the breech block 9 are preferably effected by snap-locking means, as for example, a spring plunger 38 positioned between the firing pin 22 and the spindle 13 (FIG. 1) which under the bias of a spring may lock into notches 39 and 40 formed in the extractor member 32 and the casing 7 or barrel 1.

A trigger or trigger lever 41 is pivotally mounted relative to the barrel 2 and the casing 7 by means of a pivot pin 42 and is normally biased in a clockwise direction by a spring biased bolt 43. The trigger or trigger lever 41 is surrounded by a conventional trigger guard 44. On a side of the trigger lever 41 facing the striker pin 18 is disposed an intermediate lever 45 which is pivotally mounted relative to the barrel 2 and the casing 7 by means of a pivot pin or spindle 46. The lever 45 engages behind projecting stops 18*a* or 18*b* forming portions of the striker pin 18. An upper face of the trigger 41 is provided with a groove or slot or notch 47 which permits some play between the intermediate lever 45 and the trigger 41 until such time as the intermediate lever is totally housed within the notch 47 or abuts against a set screw 48 threaded into a threaded bore which opens through the groove 47 with the set screw being adapted to project a desired amount beyond the bottom face of the groove 47. Thus the trigger 41 has built-in "play" which can be adjusted by threading the screw 48 in the manner readily apparent from FIG. 1. The trigger lever 41 is locked by a safety bolt 49 which may be turned in a conventional manner between a safety position and a release position by means of a snap-action handle 50 connected thereto (FIG. 5). At a suitable point the striker pin 18 may be provided with a transverse pin which projects laterally out of the stock of the weapon through a longitudinally extending slot in this way indicating whether the striker pin is cocked or not. The latter feature is of considerable assistance particularly in regard to a sporting rifle when the firearm is used at dusk, darkening conditions or total darkness.

As is best illustrated in FIG. 1, the trigger device or mechanism 41, the cocking device or mechanism 3 et al., the striker pin 18, and the ejector mechanism 32 et al., are located generally substantially beneath the cartridge chamber 6 of the barrel 2, i.e., the rear portion of the barrel within which is the cartridge chamber 6 extends as seen in FIG. 1 to a point behind the trigger 41. In this way the overall length of the firearm 1 may be kept shorter than heretofore possible. In effect approximately between 10 to 20 milimeters can be saved as compared to conventional weapons. Thus the weapon is more compact and easier to handle. The entire lock or lock mechanism 3 is also extremely compact and is of only restricted length. The casing 7 is also compact and stable despite the openings for the breech block 8. This is because the remaining laterally spaced bridge members 10 and 11 lend high strength and rigidity to the rear portion of the casing 7, as does the integral bridge portion 7*a* which is united by the bolt to the butt 5 or portions of the barrel 2. This enables the firearm 1 to be used for the largest possible caliber cartridges, e.g. 475 Nitro-Express. Obviously the lock mechanism is also compact in structure and all devices heretofore described are housed in a minimum amount of space.

Figure 6:
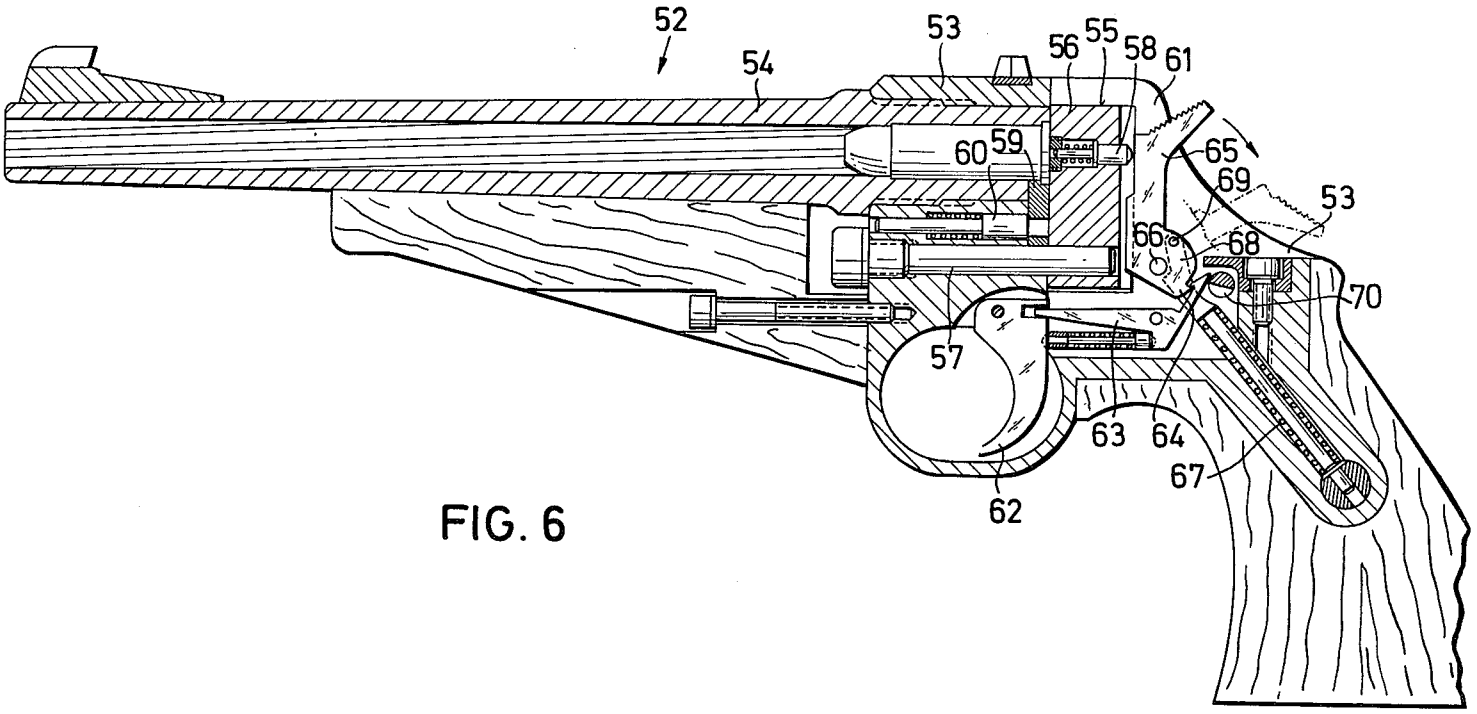
FIG. 6 is a longitudinal sectional view of a match pistol constructed in accordance with this invention and illustrates a breech block pivotally mounted in a casing recess which is in part defined by a pair of laterally spaced bridge members.

Reference is now made to FIG. 6 of the drawing which discloses a match pistol 52 having a substantially identical lock structure to that heretofore described relative to the firearm 1. The pistol or firearm 52 includes a casing or lock casing 53 which is screwed to a rear portion of a barrel 54 by threads. The casing 53 includes a casing recess 55 in which is typically mounted a pivot or breech block 56. The breech block 56 is pivoted on a spindle 57 and carries a spring-biased firing pin 58. An extractor 59 of an ejector mechanism is under the action of a spring-biased bolt 60. The casing recess 55 is likewise defined in part by laterally spaced bridge members 61 forming an integral rearward extension of the rear portion of the casing 53 which are likewise bridged at their right-hand most ends and are connected to a portion of the casing 53 by a vertical bolt received in a threaded bore of the casing 53. The pistol thus constructed is suitable for a large-caliber cartridge, e.g. 44 Remington magnum cartridge.

A trigger of trigger lever 62 operates through a catch 63 with a nose piece 64 of a firing lever 65 which is pivotally mounted by a pivot pin 66 to the casing 53. A compression spring 67 acts upon a firing lever 65 and also acts by means of a member 68 pivotally carried by a pin 69 which is mounted eccentrically relative to the axis of the pivot 66. A safety bolt is generally designated by the reference numeral 70 which enables the catch 63 to be locked and thus locks the trigger or trigger lever 62.

In this embodiment of the invention, the breech block 56 is similarly located in the rearwardly closed casing 53 and due to the laterally spaced bridge members 60 their bridging member thereof and the connection of the bridging to the right-hand most portion of the casing 53, the overall construction can absorb considerable firing stresses. Additionally, the trigger mechanism heretofore described is located substantially below the cartridge chamber of the barrel 54 and in this example also the overall length of the pistol is less than heretofore provided and the firearm is, therefore, readily easier to handle.

Although in the preferred embodiments of the invention as have been specifically illustrated and described herein, it is to be understood that minor variations may be made without departing from the spirit and scope of the invention, as defined in the appended claims.

I claim:

1. A firearm comprising a casing defining a recess, said recess being in part defined by a pair of upper spaced bridge members, a lateral opening below said bridge members opening into said recess, a breech block, means mounting said breech block in said recess for pivotal movement toward and away from said lateral opening, a cartridge chamber opening in a direction toward said recess, means for firing a cartridge located in said cartridge chamber, a trigger mechanism for operating said firing means, an ejector mechanism for ejecting spent cartridges from said cartridge chamber, and said trigger and ejector mechanisms being substantially entirely located beneath said cartridge chamber.

2. The firearm as defined in claim 1 wherein said pivotal mounting means includes a spindle projecting into said casing recess, said firing means is a firing pin slidably carried by said breech block, and spring means for normally biasing said firing in a direction away from said cartridge chamber.

3. The firearm as defined in claim 1 wherein said pivotal mounting means includes a tubular sleeve projecting into said casing recess, and said trigger mechanism includes a striker pin slidably mounted in said tubular sleeve.

4. The firearm as defined in claim 1 wherein said pivotal mounting means includes a spindle projecting into said casing recess, a slot in said breech block, said spindle being embracingly received by said slot, and releasable locking means for releasably lockingly retaining said spindle in said slot.

5. The firearm as defined in claim 1 including a generally upright groove in said casing opening in a direction toward said casing recess, said firing means includes a rocker arm housed in said upright groove, means mounting said rocker arm for pivotal movement relative to said groove, said firing means further including a firing pin slidably carried by said breech block, and an end portion of said rocker arm being in abutment with said firing pin.

6. The firearm as defined in claim 1 wherein said pivotal mounting means includes a spindle projecting into said casing recess, said firing means is a firing pin slidably carried by said breech block, and spring biased snap-action locking means carried by said breech block between said pivotal mounting means and said firing pin for locking said breech block in said casing recess.

7. The firearm as defined in claim 1 wherein said ejector mechanism includes an ejector pin, means mounting said ejector pin for sliding movement relative to said breech block, means carried by said ejector pin for engaging a cartridge rim, said cartridge rim engaging means having an outer peripheral surface, a recess in said casing opening in a direction toward said casing recess and being adapted for the receipt therein of said cartridge engaging means, said last-mentioned recess being of a configuration to generally matingly receive said cartridge rim engaging means, and means for guiding the movement of said cartridge rim engaging means during movement of the latter toward and away from said last-mentioned recess.

8. The firearm as defined in claim 1 wherein said trigger mechanism includes a striker pin slidably mounted in said casing, said striker pin includes a first terminal end portion adjacent said breech block and a second terminal end portion remote therefrom, an adjustable stop carried by said second terminal end portion and being selectively adjustably movable therealong, a cocking lever, said cocking lever having terminal ends, and means mounting said cocking lever for pivotal movement such that a terminal end of said cocking lever bears against said adjustable stop to move said striker pin in a direction away from said breech block.

9. The firearm as defined in claim 1 wherein said trigger mechanism includes a striker pin slidably mounted in said casing, said striker pin includes a first terminal end portion adjacent said breech block and a second terminal end portion remote therefrom, an adjustable stop carried by said second terminal end portion and being selectively adjustably movable therealong, a cocking lever, said cocking lever having terminal ends, means mounting said cocking lever for pivotal movement such that a terminal end of said cocking lever bears against said adjustable stop to move said striker pin in a direction away from said breech block, a trigger lever, means pivotally mounting said trigger lever relative to said casing, a lever intermediate said trigger lever and said striker pin, means pivotally mounting said intermediate lever relative to said casing, and a groove in a face of said trigger lever opening in a direction toward said intermediate lever defining a pressure-point position of said trigger lever.

10. The firearm as defined in claim 1 wherein said trigger mechanism includes a striker pin slidably mounted in said casing, said striker pin includes a first terminal end portion adjacent said breech block and a second terminal end portion remote therefrom, an adjustable stop carried by said second terminal end portion and being selectively adjustably movable therealong, a cocking lever, said cocking lever having terminal ends, means mounting said cocking lever for pivotal movement such that a terminal end of said cocking lever bears against said adjustable stop to move said striker pin in a direction away from said breech block, a trigger lever, means pivotally mounting said trigger lever relative to said casing, a lever intermediate said trigger lever and said striker pin, means pivotally mounting said intermediate lever relative to said casing, a groove in a face of said trigger lever opening in a direction toward said intermediate lever defining a pressure-point position of said trigger lever, and a set screw threaded into a bore of said trigger lever, and said bore opens into said trigger lever groove.

11. The firearm as defined in claim 1 including lever means for cocking a striker pin of said trigger mechanism, and said cocking lever means is substantially entirely located beneath said cartridge chamber.

12. The firearm as defined in claim 1 wherein said pivotal mounting means includes a spindle projecting into said casing recess, said firing means is a firing pin slidably carried by said breech block, spring means for normally biasing said firing pin in a direction away from said cartridge chamber, a firing lever, said firing lever having opposite ends, means mounting said firing lever between its ends for pivotal movement relative to said casing, a first of said firing lever ends being adapted for contact against said firing pin, and means releasably coupling a second of said firing lever ends to a trigger lever pivotally connected to said casing.

13. The firearm as defined in claim 2 wherein said pivotal mounting means includes a tubular sleeve projecting into said casing recess, said trigger mechanism includes a striker pin slidably mounted in said tubular sleeve, said striker pin having first and second end portions, said first end portion being adjacent said breech block and said second end portion being remote therefrom, means for normally biasing said striker pin for movement in a direction toward said breech block, cocking lever means mounted for pivotal movement relative to said casing, adjustable stop means carried by said second end portion and being adapted for abutting contact with a portion of said cocking lever means whereby upon pivoting of the latter said striker pin is moved in a direction away from said breech block, a rocker arm having first and second ends, means mounting said rocker arm for pivotal movement relative to said casing, said rocker arm first and second arms being in alignment for contact against said striker pin first end portion and said firing pin, respectively, said ejector mechanism includes an ejector pin, means mounting said ejector pin for sliding movement relative to said breech block, means carried by said ejector pin for engaging a cartridge rim said cartridge engaging means having an outer peripheral surface, a recess in said casing opening in a direction toward said casing recess and being adapted for the receipt therein of said cartridge rim engaging means, said last-mentioned recess being of a configuration to generally matingly receive said cartridge rim engaging means, and means for guiding the movement of said cartridge rim engaging means during movement of the latter toward and away from said last-mentioned recess.

14. The firearm as defined in claim 1 wherein said cartridge chamber is of a predetermined axial length, and the length of said recess as measured axially from said cartridge chamber is appreciably less than said predetermined axial length.

15. The firearm as defined in claim 14 including a gap defined between said bridge members, and a portion of said gap is in rearward alignment with said cartridge chamber.

16. The firearm as defined in claim 14 wherein said pivotal mounting means includes a spindle projecting into said casing recess, said firing means is a firing pin slidably carried by said breech block, and spring means for normally biasing said firing pin in a direction away from said cartridge chamber.

17. The firearm as defined in claim 15 wherein said pivotal mounting means includes a spindle projecting into said casing recess, said firing means is a firing pin slidably carried by said breech block, and spring means for normally biasing said firing pin in a direction away from said cartridge chamber.

18. The firearm as defined in claim 14 wherein said pivotal mounting means includes a tubular sleeve projecting into said casing recess, and said trigger mechanism includes a striker pin slidably mounted in said tubular sleeve.

19. The firearm as defined in claim 15 wherein said pivotal mounting means includes a tubular sleeve projecting into said casing recess, and said trigger mechanism includes a striker pin slidably mounted in said tubular sleeve.

20. The firearm as defined in claim 14 wherein said pivotal mounting means includes a spindle projecting into said casing recess, a slot in said breech block, said spindle being embracingly received by said slot, and releasable locking means for releasably lockingly retaining said spindle in said slot.

21. The firearm as defined in claim 15 including a generally upright groove in said casing opening in a direction toward said casing recess, said firing means includes a rocker arm housed in said upright groove, means mounting said rocker arm for pivotal movement relative to said groove, said firing means further including a firing pin slidably carried by said breech block, and an end portion of said rocker arm being in abutment with said firing pin.

* * * * *